US008282426B2

(12) United States Patent
Zweigle

(10) Patent No.: US 8,282,426 B2
(45) Date of Patent: Oct. 9, 2012

(54) ELECTRICAL CONTACT FOR INTERFERENCE FIT INTO HOUSING

(75) Inventor: Peter Zweigle, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 152 days.

(21) Appl. No.: 12/808,033

(22) PCT Filed: Nov. 26, 2008

(86) PCT No.: PCT/EP2008/066230

§ 371 (c)(1),
(2), (4) Date: Jul. 13, 2010

(87) PCT Pub. No.: WO2009/077299

PCT Pub. Date: Jun. 25, 2009

(65) Prior Publication Data

US 2010/0279556 A1 Nov. 4, 2010

(30) Foreign Application Priority Data

Dec. 19, 2007 (DE) ..... 10 2007 061 117

(51) Int. Cl.
*H01R 13/40* (2006.01)

(52) U.S. Cl. ..... 439/733.1; 439/499; 439/682

(58) Field of Classification Search ..... 439/733.1, 439/444, 855, 860, 862, 499, 682, 381
See application file for complete search history.

(56) References Cited

U.S. PATENT DOCUMENTS 2,848,706 A * 8/1958 Besserer ..... 439/514
2,968,786 A * 1/1961 Wootton ..... 439/752
3,312,931 A * 4/1967 Keller ..... 439/855
3,514,745 A * 5/1970 Lyon ..... 439/683
3,519,978 A * 7/1970 Taormina et al. ..... 439/596
3,764,960 A * 10/1973 Heimbrock ..... 439/749
3,777,301 A * 12/1973 Michaels ..... 439/749
3,842,396 A * 10/1974 Olsson ..... 439/685
3,995,930 A * 12/1976 Herrmann, Jr. ..... 439/582
4,056,299 A * 11/1977 Paige ..... 439/439
4,176,903 A * 12/1979 Cairo et al. ..... 439/620.21
4,269,466 A * 5/1981 Huber ..... 439/467
4,277,124 A * 7/1981 Loose et al. ..... 439/398
4,367,005 A * 1/1983 Douty et al. ..... 439/357
4,553,801 A * 11/1985 Zajeski ..... 439/595
4,565,001 A * 1/1986 Patton ..... 29/866
4,655,522 A * 4/1987 Beck et al. ..... 439/224
4,659,168 A * 4/1987 Collier ..... 439/850
4,678,121 A * 7/1987 Douty et al. ..... 439/607.47
4,693,532 A * 9/1987 Colleran et al. ..... 439/594
4,717,349 A * 1/1988 Johnson ..... 439/92
4,820,179 A * 4/1989 Saijo ..... 439/224
4,959,027 A * 9/1990 Muzslay ..... 439/655
4,995,819 A * 2/1991 Ohl ..... 439/79

(Continued)

FOREIGN PATENT DOCUMENTS

DE 196 40 466 4/1998

(Continued)

*Primary Examiner* — Neil Abrams

(74) *Attorney, Agent, or Firm* — Michael J. Striker

(57) ABSTRACT

An electrical contact (10), in particular for an electronic control unit (50), includes a number of contact pins (56) and at least one electrical cable (14) which has a connector lug (28). The connector part (12) is accommodated in an interference fit (44) in a receiving chamber (40) of a housing part (36) that includes at least one contact strip (64).

7 Claims, 2 Drawing Sheets

U.S. PATENT DOCUMENTS

| | | | | | |
|---|---|---|---|---|---|
| 5,024,610 | A * | 6/1991 | French et al. | 439/857 |
| 5,169,322 | A * | 12/1992 | Frantz et al. | 439/82 |
| 5,204,565 | A * | 4/1993 | Sekine et al. | 310/71 |
| 5,342,219 | A * | 8/1994 | Onodera et al. | 439/595 |
| 5,447,454 | A * | 9/1995 | Inaba et al. | 439/709 |
| 5,816,839 | A * | 10/1998 | Muta | 439/342 |
| 5,940,279 | A * | 8/1999 | Gademann et al. | 361/823 |
| 5,997,367 | A * | 12/1999 | Nowak et al. | 439/853 |
| 6,030,722 | A * | 2/2000 | Kuboshima et al. | 429/178 |
| 6,068,502 | A * | 5/2000 | Kuo | 439/353 |
| 6,119,668 | A * | 9/2000 | Richards et al. | 123/635 |
| 6,217,396 | B1 | 4/2001 | Hwang et al. | |
| 6,322,401 | B2 * | 11/2001 | Suzuki | 439/751 |
| 6,520,812 | B1 * | 2/2003 | Machado | 439/855 |
| 6,527,571 | B2 * | 3/2003 | Muta et al. | 439/246 |
| 7,108,565 | B2 * | 9/2006 | Boischio | 439/694 |
| 7,491,099 | B2 * | 2/2009 | Zinell et al. | 439/843 |
| 7,530,843 | B1 * | 5/2009 | Tesfay et al. | 439/587 |
| 2003/0040203 | A1 | 2/2003 | Kuroda et al. | |
| 2010/0279556 | A1 * | 11/2010 | Zweigle | 439/733.1 |

FOREIGN PATENT DOCUMENTS

| | | |
|---|---|---|
| JP | 57-173948 | 10/1982 |
| JP | 59-77271 | 5/1984 |
| JP | 63038344 | 2/1988 |
| JP | 1-142167 | 9/1989 |
| JP | 10-125417 | 5/1998 |

* cited by examiner

ELECTRICAL CONTACT FOR INTERFERENCE FIT INTO HOUSING

CROSS-REFERENCE

The invention described and claimed hereinbelow is also described in PCT/EP2008/066230, filed on Nov. 26, 2008 and DE 101007061117.1, filed Dec. 19, 2007. This German Patent Application, whose subject matter is incorporated here by reference, provides the basis for a claim of priority of invention under 35 U.S.C. 119 (a)-(d).

BACKGROUND OF THE INVENTION

In automatic vehicle transmissions, electronic control units that are installed inside the transmission housing are used to control the shift hydraulics. To prevent the transmission oil from entering this electronic control unit, the electronic control units are hermetically sealed e.g. by welding housing bases and housing covers to one another. The electrical contacts are customarily guided outwardly through glass sealing or glazed enclosures. The design of electronic control units of this type is substantially similar to that of metallic transistor housings but include a larger number of contact pins. Metallic pressed screens are applied to the outer end face of the contact pins to conduct the electrical signals. The former are customarily connected permanently to the contact pins using a bonding method such as laser welding. These pressed screens are coated with plastic to position the parts to be welded and to provide short-circuit-proof insulation.

DE 196 40 466 B4 relates to a metallic carrier part that includes electronic components applied to the component side and/or to printed circuit boards. The printed circuit boards are, in particular, hybrid circuits having connections that are inserted from the component side to the side of the carrier part opposite the component side using a plurality of lead pins sealed in glass passages. The lead pins are disposed on at least one metallic contact strip provided with passage openings. A lead pin sealed in a glass filling is disposed in each passage opening. The contact strip is inserted into an assigned recess in the carrier part and is fastened therein.

Regarding the above-described configuration, it is difficult to ensure adequate flexibility to compensate for component tolerances or to achieve deformation during an assembly procedure. Moreover, the tools required to produce the plastic-coated pressed screens are very expensive. Likewise, any geometric change or the creation of a component variant is a complex undertaking and increases costs. If a wiring harness is used to achieve flexibility, a short but coated pressed screen is typically required as an intermediate part to connect the cable ends since it is only possible to weld the contact pins to a fixed sheet-metal surface and not to connect them directly to the flexible cables.

SUMMARY OF THE INVENTION

According to the invention, coated pressed screens used previously are replaced by a plastic guide part without coated metallic parts. Uniform weld flanges are inserted in this plastic guide part and are fixedly anchored using a pine-tree profile, to name one example. On the profiles that are used, which can be designed e.g. as a pine-tree profile, the electrical connecting cables are first attached by crimping, for example, or they are attached in another manner.

The proposed solution has considerable cost advantages compared to the coated pressed screen. The reuse of an identical, small punched-bent part also results in very low tool costs, and the solution provided according to the present invention is characterized by excellent tolerance compensation and provides a certain amount of mobility even in tight spaces. The solution provided according to the invention makes it possible to realize a large variety of types, that is, a relatively large number of variants, coupled with very low costs for changes and tools. The assembly of the electrical cables can be automated, or carried out by a subcontractor.

In the solution provided according to the invention, the connector lugs, which are also referred to as terminals, are first connected to the electrical cables by crimping, for example. The working procedure is identical to that of attaching known connector terminals to electrical cables and can be implemented by any cable manufacturer, and may even be automated. It is possible, for example, to assemble the electrical cables where the other cable end was assembled. The cable end opposite the cable end to be assembled can also remain exposed.

The weld flange provided according to the invention is designed without snap-in hooks and includes a pine-tree contour on the outer side, for example. In the case of the connector snap-in that is typically used, the connector terminal is seated in the corresponding receiving chamber with play. In the solution provided according to the invention, however, a play-free, stressable interference fit is required because the forces introduced from the electrical connecting cable would otherwise act on the weld point of the electronic control unit, which is to be avoided. Using the weld flange provided according to the invention, the forces introduced from the cable can be decoupled from the weld point of the electronic control unit.

In a second step, the weld flanges are inserted into a housing part. When the spacial conditions are tight, the crimping region within which the weld flange provided according to the invention is connected to the electrical cable at any angle relative to the welding "flat". In this case, the welding "flat" is understood to mean the connector lug that is bonded to the particular contact pin of an electronic control unit, preferably being welded thereto in this case, thereby resulting in an electrically conductive contact. Care must merely be taken to ensure that the force-introduction area is accessible for press fitting, and this is ensured by the plane offset.

The plastic housing part is a component that is preferably derived from a component of the transmission control that is available, although it can have a different appearance and can transition e.g. into a supporting frame, a cable duct, or the like.

BRIEF DESCRIPTION OF THE DRAWINGS

The present invention will be described in greater detail below with reference to the drawings. They show.

DETAILED DESCRIPTION OF THE PREFERRED EMBODIMENTS

Figure 1:
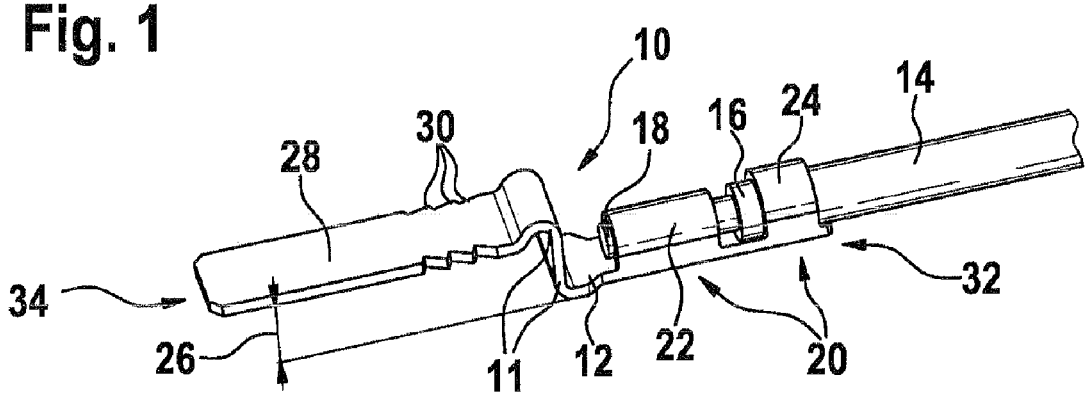
FIG. 1 a first embodiment of a connection between an electrical cable and a connector part, FIG. 2 the connector part shown individually in FIG. 1, accommodated in a receiving chamber of a housing part designed as a contact strip, FIG. 3 the fully contacted housing part according to the depiction in FIG. 2, including a large number of electrical cables, and FIG. 4 the housing part designed as a contact strip, accommodated on contact pins that extend out of the electronic control unit.

The depiction shown in FIG. 1 is a perspective view of the connector part, which is provided according to the invention, of the electrical contact.

As shown in FIG. 1, an electrical contact 10 includes a connector part 12. Reference numeral 11 labels a point at which force is introduced into connector part 12. Connector part 12 is designed as a punched-bent part in the depiction shown in FIG. 1. An electrical cable 14 is fastened to one end of the connector part 12 using crimping 20; the other end of connector part 12 is designed as connector lug 28.

On connector part 12, electrical cable 14 is accommodated in crimping 20 and includes cable sheathing 16 and a conductor 18. As shown in FIG. 1, crimping 20 includes a first curvature 22 and a second curvature 24, each of which creates a form-fit connection between conductor 18 and cable sheathing 16 and connector part 12 which is preferably designed as a punched-bent part. Using crimping 20, it is possible to fasten more than one electrical cable 14—as shown in FIG. 1—to connector part 12 which is preferably designed as a punched-bent part, as depicted in FIG. 1.

As furthermore shown in the depiction in FIG. 1, connector part 12 includes a plane offset 26. "Plane offset" 26 is intended to mean that connector lug 28 lies in a second plane 34, while crimping 20 with connector part 12 and electrical cable 14 lies in a first plane 32 of connector part 12. First plane 32 and second plane 34 are offset relative to each other by a plane offset 26. Connector lug 28, which lies in second plane 34, includes a welding "flat" 38. Welding "flat" 38 is the part of connector lug 28 that is bonded to contact pins 56 of electronic control unit 50 (see the depiction in FIG. 4), being welded thereto, for example.

While the end, shown in FIG. 1, of electrical cable 14 is connected via crimping 20 having first curvature 22 and second curvature 24 to connector part 12 of electrical contact 10, the other end of electrical cable 14 can likewise be provided with an electrical contact 10, or can include another contact or remain exposed.

Connector lug 28 shown in FIG. 1, which lies in second plane 34 of connector part 12 designed, in particular, as a punched-bent part, has profiling 30 on its outer edge. The profiling applied to the outer edge of connector lug 28 can include e.g. individual projections having a sawtooth shape, or profiling 30 can have a pine-tree structure. Profiling 30 on lateral surfaces of connector lug 28 of connector part 12 is used to manufacture an interference fit 44 of connector part 12 in a housing part 36 to be described.

Figure 2:
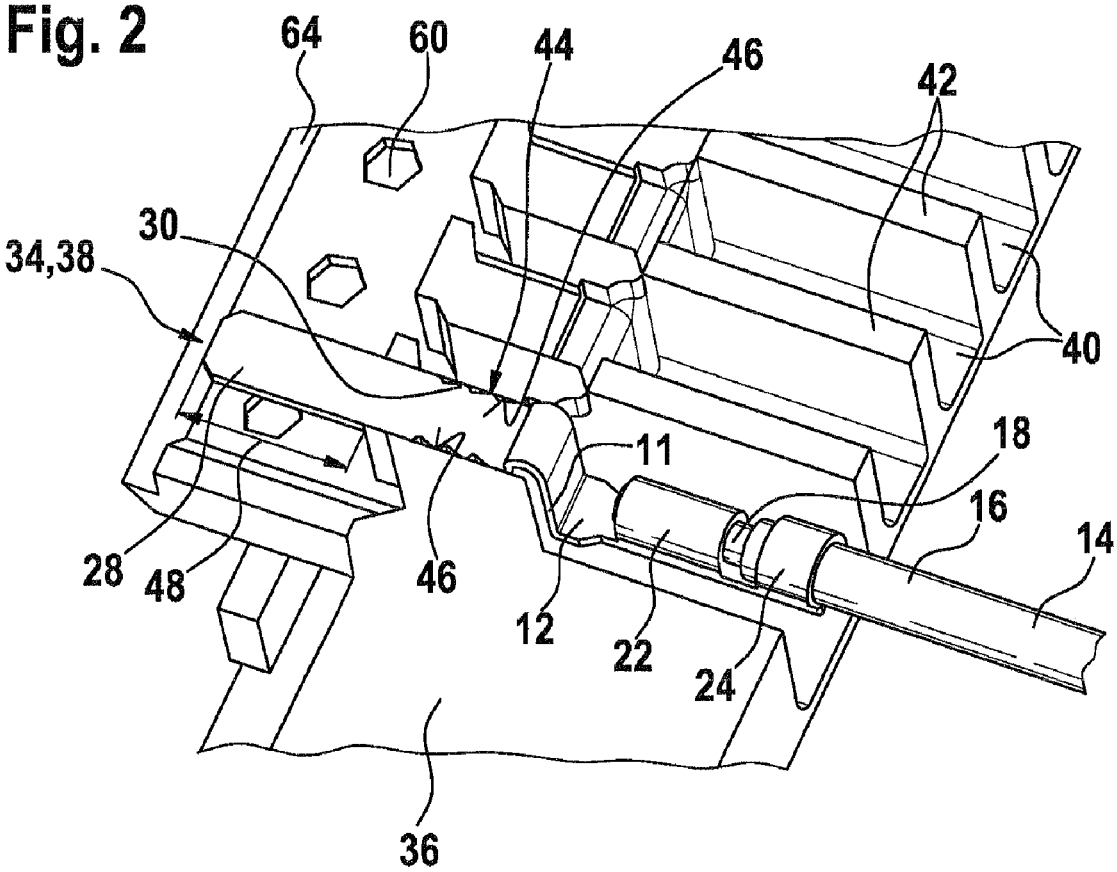

FIG. 2 shows a perspective top view of a section of a housing part designed as a contact strip.

A housing part 36, which is shown in a partial depiction in FIG. 2, is designed in the form of a contact strip 64. A number of receiving chambers 40 is located in housing part 36 which is designed as contact strip 64. Receiving chambers 40 are designed to receive connector part 12 which is preferably designed as a punched-bent part. An interference fit 44 is used to fix connector part 12, which is preferably designed as a punched-bent part, in one of the receiving chambers 40 of housing part 36. Interference fit 44 is characterized in that lateral profiling 30 on connector lugs 28 interacts on both sides with profiling 30 of diametrically opposed interference fit surfaces 46 of receiving chambers 40. Profiling 30, which is preferably formed on the lateral surfaces of conductor lug 28 of connector part 12, is used to ensure a play-free interference fit 44 of connector part 12 of electrical contact 10 in housing part 36 which is preferably designed as contacting strip 64. Forces, e.g. tension forces, that act on connector part 12 are absorbed by force-introduction point 11 of connector part 12. Mechanical tensile stresses are introduced into housing part 36 through interference fit 44 and are not absorbed by crimping 20 which lies in first plane 62 on the base of receiving chamber 40 of housing part 36. Each receiving chamber 40 in housing part 36 is bounded by chamber walls 42 or interference-fit surfaces 46. Interference-fit surfaces 46 are closer to each other than chamber walls 42 that bound receiving chamber 40. Housing part 36, which is preferably designed as contact strip 64, can be manufactured using plastic injection molding and can even have a structure that differs from the strip-shaped structure as shown in the perspective top view in FIG. 2. Housing part 36 according to the perspective view in FIG. 2 can also be designed as a supporting frame, a cable duct, or the like. As shown in the depiction in FIG. 2, connector parts 12 of electrical contact 10 are slid into receiving chambers 40 in a level manner. Connector parts 12 are fixed in position using aforementioned interference fit 44 between lateral profiling 30 of connector lug 28 and interference-fit surfaces 46.

In the state in which connector part 12 is installed in receiving chamber 40, connector lug 28, on which lateral profiling 30 has preferably been formed, is disposed above the edge of housing part 36 by an overhang 48. As a result, connector lug 28 including welding "flat" 38 extends above openings 60 for contact pins 56. Openings 60 in contact strip 64 of housing part 36 are used to receive contact pins 56 of an electronic control unit 50. As soon as housing part 36 is fastened to electronic control unit 50 using connector parts 12, which are locked in position in receiving chambers 40 using interference fit 44, contact pins 56 extend through openings 60 and are thereby disposed underneath connector lugs 56, which cover openings 60 in a flush manner, of each of the connector parts 12. Next, depending on the orientation and number of contact pins 56, which should be contacted, on electronic control unit 50 (see the depiction in FIG. 4), a bonded, electrically conductive connection is created, preferably using laser welding, between connector lugs 28 of connector parts 12 and contact pins 56 which extend through openings 60 in housing part 36 which is designed as contact strip 64.

Figure 3:
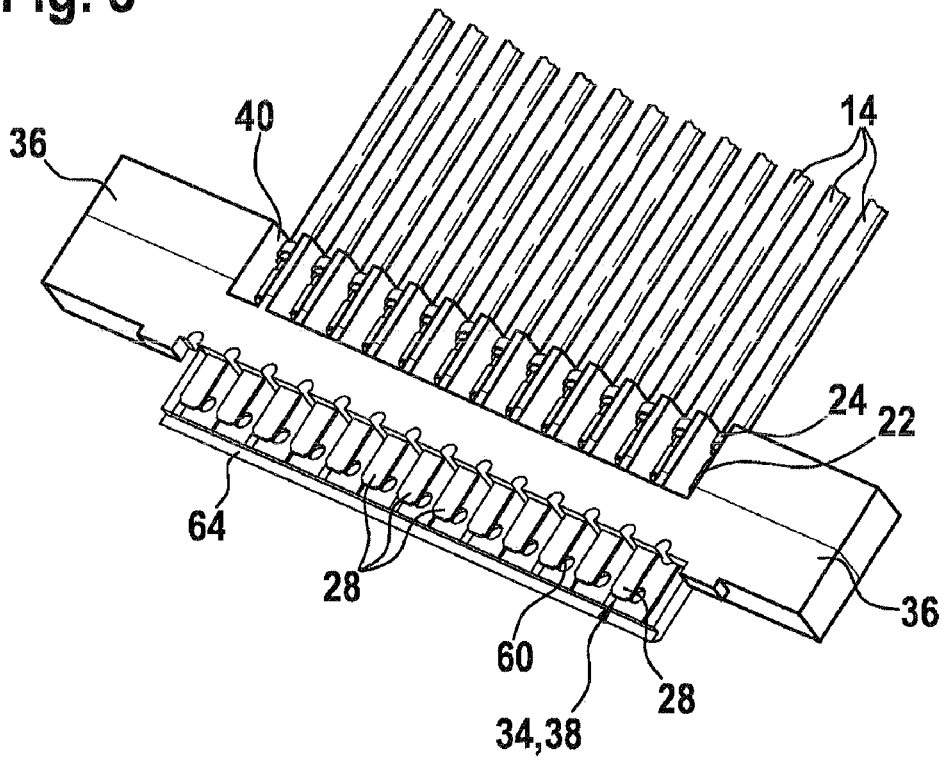

The illustration presented in FIG. 3 shows a perspective view of housing part 36 that is designed as a contact strip.

As shown in the perspective view in FIG. 3, housing part 36 designed as contact strip 64 includes a number of adjacent receiving chambers 40. As mentioned above, each receiving chamber 40 is bounded by chamber walls 42. A connector part 12 is inserted into each receiving chamber 40 of housing part 36. The former is fixed in position using interference fit 44, which was described above in conjunction with FIG. 2, between interference-fit surfaces 46 of receiving chambers 40 and profilings 30, which are preferably formed on the sides of connector lug 28. As shown in the perspective view in FIG. 3, a connector part 12 is inserted in each receiving chamber 40 of housing part 36. FIG. 3 also shows that particular connector lugs 28 of connector parts 12 overlap openings 60 in contact strip 64 to receive contact pins 56 which lie in second plane 34 of connector part 12.

Figure 4:
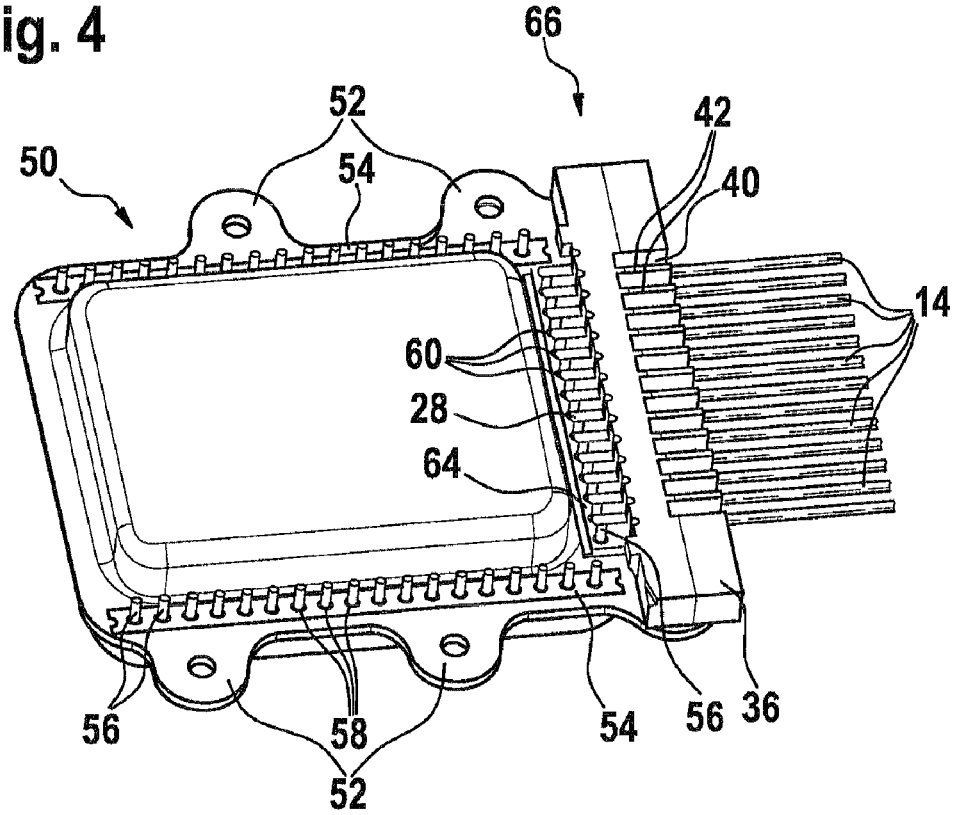

As shown in the depiction in FIG. 4, the housing part shown in FIG. 3 is accommodated on an electronic control unit.

An electronic control unit 50 according to the perspective top view in FIG. 4 includes a cover and a tray-shaped base part. An edge 54 extends on tray-shaped base part of electronic control unit 50, which is closed by the cover. A number of contact pins 56 extend through edge 54. Contact pins 56 are accommodated in glazed enclosures 58 to effectively protect the interior of electronic control unit 50 hermetically toward the outside e.g. against the atmosphere surrounding electronic control unit 50 or against an automatic transmission fluid (ATF) that has aggressive properties and surrounds electronic control unit 50 on a vehicle transmission, for example.

As shown in the illustration in FIG. 4, contact pins 56 extend beyond glazed enclosures 58 in edge 54 of electronic control unit 50 by a distance. While two diametrically opposed rows of contact pins 56 are designed to be exposed, contact pins 56 are contacted via housing part 36 to a row of contact pins 56 that extends substantially in the vertical direction. FIG. 4 shows that housing part 36, which is designed in the form of a contact strip 64, covers contact pins 56 which are accommodated in glazed enclosures 58 and are provided laterally in edge 54 of electronic control unit 50. Contact pins 56 extend through openings 60 of housing part 36 designed as contact strip 64. Connector lugs 28 overlap the end faces of contact pins 56, thereby making it possible to create a bonded, electrically conductive connection between the end faces of contact pins 56 and connector lugs 28 of connector parts 12 e.g. using laser welding. While housing part 36 is fastened to electronic control unit 50 in a first vertical position 66, as shown in the depiction in FIG. 4, housing part 36 can also be bonded to corresponding contact pins 56 of electronic control unit 50 at a right angle thereto, in a substantially horizontal position.

FIG. 4 also shows that each receiving chamber 40 of housing part 36 can be provided with an electrical cable 14. It is also possible to leave some of the adjacent receiving chambers 40 in housing part 36 empty. This depends on the orientation or positioning of contact pins 36, which will be contacted using connector lugs 28, in edge 54 of electronic control unit 50. Contact pins 56, which are customarily accommodated in glazed enclosures 58 in edge 54, contact electronic components disposed in the interior of electronic control unit 50. Electronic control unit 50, which can be an electronic control unit for a vehicle transmission or the like, includes the cover and a tray-shaped base part. A number of tabs 52 are located in tray-shaped base part, offset relative to each other in this case. Tabs 52 extend substantially in the plane of edge 54 of tray-shaped base part of electronic control unit 50.

Housing part 36 according to the depictions in FIGS. 3 and 4 can be advantageously manufactured of plastic e.g. using the one-component or two-component injection-molding method. Depending on the configuration and the installation space, housing part 36 can have a strip-shaped appearance, as shown in the depictions in FIGS. 3 and 4. Further cable ducts or the like, which are not depicted here in the drawings, can also adjoin the region of contact strip 64 of housing part 36 shown in FIG. 3. Housing part 36, which preferably encloses a contact strip 64, can be disposed in any orientation 66 relative to electronic control unit 50 in order to exactly contact pins 56 which should be electrically connected. These can be entirely different contact pins 56 having different contacts relative to electronic control unit 50, depending on the application of electronic control unit 50. In this regard, great flexibility is achieved using the solution, which is provided according to the invention, of electrical contact 10. In the depiction shown in FIG. 4, only one housing part 36, which is designed as contact strip 64, is connected in an electrically conductive manner to a number of contact pins 56 of electronic control unit 50. It is entirely possible, however, to electrically connect contact pins 56, which are still exposed in FIG. 4, to electrical contact 10 provided according to the invention using a housing part 36 which preferably includes contact strip 64.

What is claimed is:

1. An electrical contact (10) for an electronic control unit (50), comprising:

a number of contact pins (56) for electrical connection provided thereon, the electrical contact (10) including at least one electrical cable (14) and which has a connector part (12) comprising a connector lug (28), wherein the connector part (12) is accommodated in an interference fit (44) in a receiving chamber (40) of a housing part (36) that includes at least one contact strip (64), wherein the connector part (12) has a first plane (32) and a second plane (34) that are offset relative to each other by a plane offset (26), wherein in the first plane 932), the electrical cable (14) is connected to the connector part (12), wherein the connector lug (28) extends in the second plane (34), and wherein the connector lug (28) in the interference fit (44) of the connector part (12) extends in an overhang (48) above openings (60) provided in the contact strip (64) for receiving the contact pins (56) of the electronic control unit (50) and guiding the contact pins (56) into engagement with the connector lugs (28), and wherein the overhang (48) is oriented perpendicular with respect to end faces of the contact pins (56) of the electronic control unit (50).

2. The electrical contact (10) according to claim 1, wherein the connector part (12) is a punched-bent part, and the connector lug (28) in said interface fit (44) has profiling (30).

3. The electrical contact (10) according to claim 1, wherein the connector lug (28) is accommodated without play in the interference fit (44) on interference-fit surfaces (46) of a receiving chamber (40).

4. The electrical contact (10) according to claim 1, wherein the electrical cable (14) is connected to the connector part (12) being fastened thereto using crimping (20; 22, 24).

5. The electrical contact (10) according to claim 2, wherein profiling (30) on a side of said lug (28) in said interference fit (44).

6. The electrical contact (10) according to claim 1, wherein the housing part (36) that includes at least one contact strip (64) has a number of receiving chambers (40).

7. The electrical contact (10) according to claim 1, wherein the housing part (36) can be positioned relative to the electronic control unit (50) in accordance with a position of the contact pins (56) of the electronic control unit (50) to be contacted.

* * * * *